United States Patent [19]

Barton

[11] Patent Number: 4,605,158

[45] Date of Patent: Aug. 12, 1986

[54] CARTON DIVIDER WITH POSITIONING MEANS

[75] Inventor: Harold A. Barton, South Pasadena, Calif.

[73] Assignee: Owens-Illinois, Inc., Toledo, Ohio

[21] Appl. No.: 748,107

[22] Filed: Jun. 24, 1985

Related U.S. Application Data

[63] Continuation of Ser. No. 498,384, May 26, 1983, abandoned.

[51] Int. Cl.[4] ..... B65D 1/36

[52] U.S. Cl. ..... 229/15; 229/27; 229/28 R

[58] Field of Search ..... 229/28 R, 27, 15

[56] References Cited

U.S. PATENT DOCUMENTS

| | | | |
|---|---|---|---|
| 2,475,107 | 7/1949 | Newsom | 229/27 |
| 2,749,012 | 6/1956 | Beach | 229/15 |
| 3,921,893 | 11/1975 | Randle, Jr. | 229/15 |
| 3,982,684 | 9/1976 | David | 229/28 R |

*Primary Examiner*—Joseph Man-Fu Moy
*Attorney, Agent, or Firm*—John R. Nelson

[57] ABSTRACT

A carton divider is provided with a hingedly connected positioning flap of a length dimension that is approximately the width of the carton. The positioning flap is fastened to an end closure wall of the carton, such as the bottom wall, by adhesive or the like. The divider upon folding and assembly into the carton is held in registered, aligned placement by the positioning flap overcoming improper divider position for machine drop loading articles (such as bottles) into the carton and fall out of the divider during machine decasing of the contents.

3 Claims, 3 Drawing Figures

CARTON DIVIDER WITH POSITIONING MEANS

This is a continuation of application Ser. No. 498,384 filed May 26, 1983, now abandoned.

BACKGROUND

This invention relates to partitions and dividers for cartons adapted to separate articles packed therein, and specifically to the placement and location of a divider in a carton.

Carton dividers in use at present are beset with shortcomings whereby after placement of the divider member in the carton it is free to move to one side or another in the carton and interfere with entry of drop loaded articles. And, during decasing of cartons loaded with articles the dividers become dislodged and may fall out with the decased articles. Examples of corrugated dividers for rectangular corrugated cartons are disclosed in U.S. Pat. Nos. 1,860,567; 3,738,561; 3,921,893; 3,931,924; 3,982,684; 3,317,111 and 3,758,018.

SUMMARY OF THE INVENTION

The imroved carton of the present invention provides a carton divider (a partition element for purposes of this invention, is synonomous with "divider") with a hinged positioner flap. The positioner flap is fastened to the carton in the assembly therewith to hold the divider element in proper placement while loading the carton and during decasing.

An important feature of the invention is the provision of a positioner flap as part of a flat blank of the divider element. The blank of the divider is folded and assembled by conventional means. In the assembly of carton and divider, adhesive may be applied to secure the positioner flap to an end closure wall of the carton, such as the bottom end closure wall. The adhesively secured positioning flap holds the divider in a proper placement in the carton and overcomes the aforementioned difficulties.

DESCRIPTION OF DRAWINGS

The invention is disclosed in conjunction with the drawings, wherein.

DETAILED DESCRIPTION OF THE DRAWINGS

Carton dividers in use may be of several forms; one example of such being shown and described herein.

Figure 1:
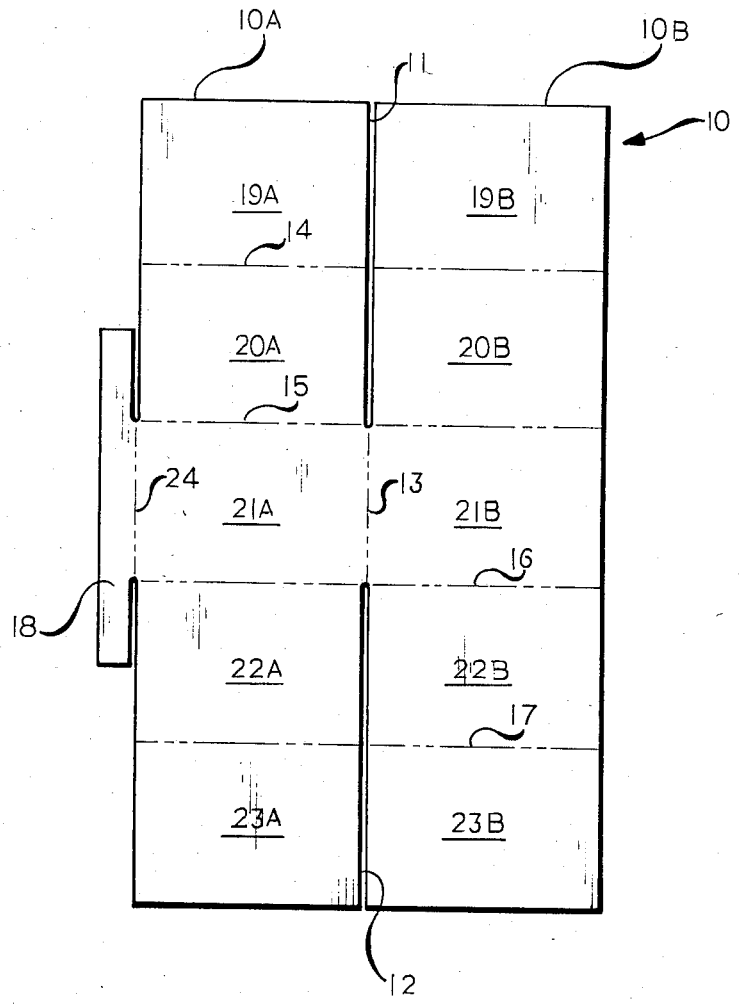
FIG. 1 is a plan view of a carton divider constructed according to the present invention.

FIG. 1 is a die cut, scored blank 10 of an H-divider made in accordance with the invention. The blank 10 has opposed slots 11 and 12 made along its longitudinal center line. The slots 11 and 12 are connected by score line 13 forming a hinge about which the blank is folded centrally into two halves 10A and 10B. There are four aligned transverse score lines 14–17 which span halves 10A and 10B. In each of the halves 10A and 10B, the score lines 14–17 define five panels comprising the opposite end panels 19 and 23, and a pair of intermediate panels 20 and 22 on either side of a central panel 21.

Along one longitudinal side of the blank (such as 10A) there is a die cut positioning flap 18 that is hingedly connected to the central panel 21A at the scored fold line 24. In the preferred embodiment, flap 18 is die cut integral with the corrugated sheet of the main blank forming an H-divider, or the like. The length of positioning flap 18 should be approximately the width of the carton measured interiorly between its side walls. As will be presently described, the flap 18 is fastened into the carton 30 by one of two means. Alternatively, the positioning flap 18 may be hingedly secured to the blank by other means, such as by tape.

Figure 2:
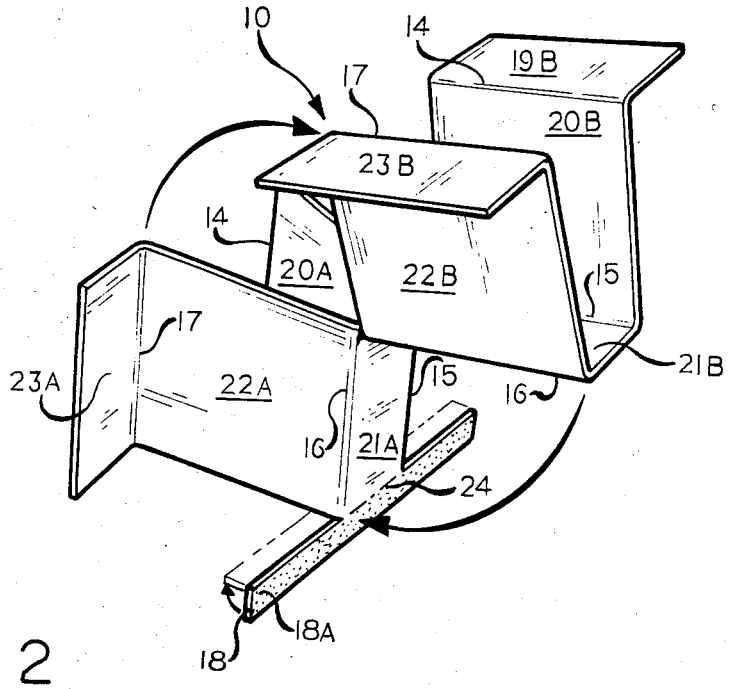
FIG. 2 is a perspective view of the divider of FIG. 1 showing it being folded for assembly into a carton.

The blank 10 is shown as being folded to an H-divider in FIG. 2. In so doing, the central panels 21A and 21B are brought into back-to-back relationship. The portion 10A of the blank has its intermediate panels 20A and 22A folded, respectively, on score lines 15 and 16 toward each other and disposed at an angle to central panel 21A. The end panels 19A and 23A are folded outwardly along their respective fold lines 14 and 17 to lie substantially parallel with central panel 21A. The portion 10B of the blank is similarly folded so that intermediate panels 20B and 22B are angled from central panel 21B and end panels 19B and 23B are each outwardly folded to lie parallel with central panel 21.

The positioning flap 18 is preferrably adhesively coated or treated along its inwardly facing surface 18A, the flap being folded outwardly at the time the divider is placed in the carton 30 so that the positioning flap 18 is fastened to one or both of the bottom flaps 43 or 44 of the carton bottom end closure wall and disposed transversely of the carton.

Alternatively, the positioning flap 18 may be sized in length to provide a friction fit between the vertical walls 35 and 36 of the carton, thereby holding the divider in proper placement in the carton.

Figure 3:
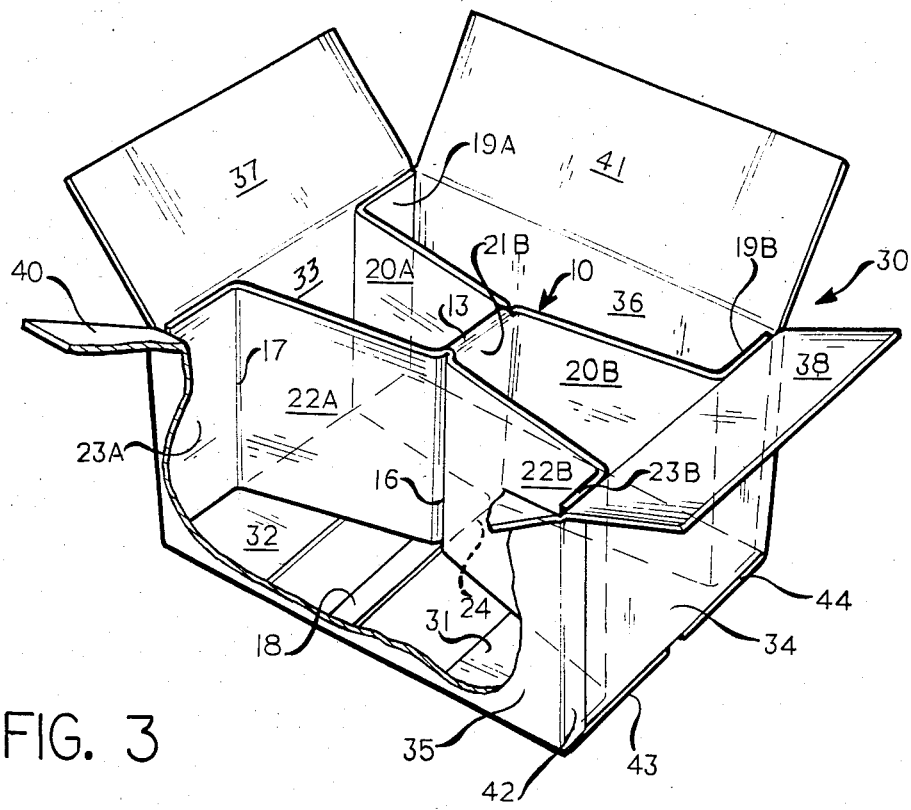
FIG. 3 is a perspective view of a carton, partially broken away, showing a carton divider of the invention assembled therein and fastened in place.

Carton 30 is preferrably a KD carton joined at a corner by a manufacturers joint 42 (FIG. 3) to provide end walls 33 and 34 and side walls 35 and 36. As is conventional in KD cartons, the end walls 33 and 34 have, respectively, top end flaps 37 and 38 and bottom end flaps 32 and 31. Similarly, side walls 35 and 36 have, respectively, top side flaps 40 and 41 and bottom side flaps 43 and 44. The bottom flaps may be folded and glued in a carton flap sealing machine when the carton 30 is erected to receive the divider 10. With the divider 10 fastened in place, such as shown on FIG. 3, plural compartments are provided in the carton and it may be drop loaded with articles, such as empty gallon-size containers. Containers (not shown) are loaded bottom side-up and the several top flaps are next folded to close the carton with containers in it for shipment.

Employing the invention, such as described herein, can result in material saving. The end panels 19A, 23A and 19B and 23B may be made of shorter dimension than otherwise. The conventional H-divider (not made according to the invention) needs a certain width dimension of the end panels thereof to establish the proper location (position) of the divider in the carton.

At the time of decasing the articles, such as by a machine decasing operation, the top flaps are opened and the articles (e.g. empty bottles) dropped from the carton in upright fashion onto a receiving surface, e.g. a conveyor. During decasing, the positioning flap of this invention retains divider 10 in the carton. The carton with divider 10 in place may be reused, such as by placing filled bottles into the compartments of the carton. Thereafter, the closure flaps of carton 10 are folded and sealed for shipment. With the divider 10 held in proper position, the compartments are maintained for automatic casing, such as by an automatic drop-packer device.

Conversely, the positioning flap 18 may be secured in the carton by applying adhesive in a pattern along the inside surface of one of the bottom flaps, such as flap 43, to adhesively fasten the positioning flap in place in the carton. Or, the positioning flap may be fastened in place by mechanical means, such as stapling or stitching.

Another form of divider may be made from a blank consisting of one half of the divider blank 10, such as 10A. This will provide three in-line compartments in a carton in which case the central panel 21A lies along one side wall of the carton and end panels 19A and 23A lie along the opposite side wall of the carton. The positioning flap 18 is used in a manner previously described to fasten the divider in the carton in its proper position.

Another alternative for carton assembly is in the placement of the folded H-divider 10 inside the side and end walls of the carton before the bottom flaps are folded inwardly. Thereby, the positioning flap 18 may be glued by the carton flap sealing machine in step with folding and gluing the bottom flaps of the carton during its assembly. This allows further saving in assembly cost of the invention in a divided carton.

The divider of this invention may be modified so as to be effectively used with a variety of cartons, or the like.

What is claimed is:

1. In a rectangular corrugated paperboard carton having opposed pairs of vertical side walls defining a rectangular perimeter thereof, each said wall having flaps at either vertical end, respectively, foldable to form opposite end closure walls of said carton, the combination therewith of a divider formed from a rectangular blank of corrugated paperboard having a longitudinal center line, opposite end panels on either side of said center line, an intermediate panel hingedly connected to each of said end panels and a rectangular center panel on opposite sides of said center line hingedly connected at both side edges to the intermediate panels adjacent thereto, center panels being hingedly connected at a top edge to each other along the said center line, and a center line slot on either side of said center panels separating the end and intermediate panels on one side of the center line from the end and intermediate panels on the other side thereof;

said central panels having a width substantially less than the width of the carton within which the divider is adapted to be positioned, a positioning flap hingedly connected to the free edge of one of said central panels, said positioning flap having a length greater than the width of the central panel and extending beyond both side edges of the central panel;

said divider being folded at said center line to form a generally H-shaped divider for insertion in the carton with the positioning flap in surface engagement with the bottom end closure wall of the carton;

and interengaging means between said positioning flap and said carton for holding the divider in assembled position in said carton.

2. The rectangular carton and divider combination of claim 1 wherein the length of the positioning flap is substantially the same as the width of said bottom end closure wall whereby the interengaging means holding the positioning flap in the carton is a friction fit of the positioning flap between opposite vertical walls of the carton.

3. The rectangular carton and divider combination of claim 1 wherein said interengaging means for holding the positioning flap in the carton is an adhesive connection between the positioning flap and at least one of the flaps of one of said bottom end closure walls of the carton.

* * * * *